US008766076B2

(12) United States Patent
Ishida

(10) Patent No.: US 8,766,076 B2
(45) Date of Patent: Jul. 1, 2014

(54) KEYBOARD DEVICE FOR ELECTRONIC KEYBOARD INSTRUMENT

(75) Inventor: Hideyuki Ishida, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 34 days.

(21) Appl. No.: 13/004,581

(22) Filed: Jan. 11, 2011

(65) Prior Publication Data

US 2011/0179935 A1 Jul. 28, 2011

(30) Foreign Application Priority Data

Jan. 25, 2010 (JP) ..... 2010/013138

(51) Int. Cl.
*G10C 3/12* (2006.01)
*G10H 1/34* (2006.01)

(52) U.S. Cl.
CPC ..... *G10H 1/346* (2013.01); *G10H 1/34* (2013.01); *G10H 1/348* (2013.01)
USPC ..... 84/433

(58) Field of Classification Search
CPC ..... G10H 1/346; G10H 1/348; G10H 1/34
USPC ..... 84/433
See application file for complete search history.

(56) References Cited

U.S. PATENT DOCUMENTS

| | | | | |
|---|---|---|---|---|
| 4,901,614 | A * | 2/1990 | Kumano et al. | 84/719 |
| 6,765,142 | B2 * | 7/2004 | Sakurada et al. | 84/719 |
| 2003/0159571 | A1 * | 8/2003 | Yamaguchi | 84/720 |

FOREIGN PATENT DOCUMENTS

| | | |
|---|---|---|
| JP | 58-85736 | 6/1983 |
| JP | 4-46493 | 4/1992 |
| JP | 2004-198721 | 7/2004 |

OTHER PUBLICATIONS

Office action issued in corresponding Japanese patent application No. 2010-013138 on Jan. 7, 2014, 2pp.

* cited by examiner

*Primary Examiner* — Jianchun Qin

(74) *Attorney, Agent, or Firm* — Christie, Parker & Hale, LLP

(57) ABSTRACT

A keyboard device for an electronic keyboard instrument, capable of ensuring stable contact between movable contacts and fixed contacts of a switch body, to accurately detect key depression information. A hammer has a pressure-applying surface formed in a predetermined configuration. A key switch detects key depression information and includes a substrate with fixed contacts, a hollow switch body with a pressure-receiving surface, and movable contacts provided inside the body. Pressing of the pressure-receiving surface by the pressure-applying surface sequentially brings the movable contacts into contact with the fixed contacts, causing switch body compressive deformation. The pressure-receiving surface and pressure-applying surface are complementary in shape, and an orientation of the former conforms to an orientation of the latter when hammer pivotal motion is terminated after the movable contacts are brought into contact with the fixed contacts.

2 Claims, 5 Drawing Sheets

KEYBOARD DEVICE FOR ELECTRONIC KEYBOARD INSTRUMENT

CROSS-REFERENCE TO RELATED APPLICATION

This application claims priority of Japanese Patent Application Number 013138/2010, filed on Jan. 25, 2010.

BACKGROUND OF THE INVENTION

1. Field of the Invention

This invention relates to a keyboard device for an electronic keyboard instrument, such as an electronic piano, which is provided with a key switch for detecting key depression information on each key.

2. Description of the Related Art

Conventionally, there has been proposed a keyboard device of the above-mentioned type e.g. in Japanese Laid-Open Utility Model Publication (Kokai) No. H04-46493.

The keyboard device has a plurality of keys, a plurality of hammers, and a key switch each mounted on a chassis. Each key extends in the front-rear direction and has a rear end thereof pivotally supported on the chassis. Each hammer is disposed below an associated one of the keys and has a front portion thereof pivotally supported on the chassis. The key is in contact with the front end of the associated hammer from above. Further, the hammer has an upwardly protruding pressure-applying portion integrally formed therewith at a location close to the center thereof, and the pressure-applying portion has an upper surface thereof formed as a flat pressure-applying surface.

The key switch comprises a substrate and a plurality of switch bodies, and is disposed above the hammers. The substrate, which is screwed to the chassis, extends horizontally in the left-right direction. Further, first and second fixed contacts are attached to the lower surface of the substrate at respective locations close to and remote from an associated one of hammer supports, in a manner spaced from each other by a predetermined distance in the front-rear direction. Each switch body is formed as a hollow member of an elastic material, such as rubber, and is disposed on the substrate in a manner covering the first and second fixed contacts. The switch body has a flat lower surface (hereinafter referred to as "the pressure-receiving surface") disposed substantially parallel to the lower surface of the substrate in a manner opposed to the pressure-applying surface of the hammer from above. Further, the switch body is provided with a first movable contact and a second movable contact. The first movable contact and the second movable contact are opposed to the respective first and second fixed contacts, and the distance between the second movable contact and the second fixed contact is slightly larger than that between the first movable contact and the first fixed contact.

With this construction, when the key is depressed, the front end of the hammer is pressed by the key, whereby the hammer pivotally moves to press the switch body by the pressure-applying portion. As a consequence, the first movable contact of the switch body is brought into contact with the first fixed contact, and then the second movable contact of the switch body is brought into contact with the second fixed contact, whereby detection signals indicative of the respective contact states are output. Based on the detection signals and a time lag between the two detection signals, key depression information including information on depression or non-depression of the key, key depression speed of the same, etc. is detected.

However, according to the conventional keyboard device, there is a fear that the key depression information cannot be accurately detected for the following reason: FIGS. 5A to 5C schematically show the positional relationship between the hammer 62 and the switch body 63 of the conventional keyboard device 61 and the operating state of the switch body 63. In a key-released state shown in FIG. 5A, the pressure-receiving surface 63*a* of the switch body 63 is positioned substantially parallel to the lower surface of the substrate 65 as described hereinbefore, whereas the pressure-applying surface 62*a* of the hammer 62 is rearwardly and downwardly inclined. When the key (not shown) is depressed in this state, the hammer 62 is brought into contact with the pressure-receiving surface 63*a* of the switch body 63 via the pressure-applying surface 62*a* to press and compress the switch body 63. When the amount of pivotal motion of the hammer 62 is small as shown in FIG. 5B, the whole switch body 63 is compressed by a substantially uniform degree of compression.

In general, to make a touch feeling provided by an electronic keyboard instrument more similar to a touch feeling provided by an acoustic piano, it is necessary to pivotally move the hammer through somewhat larger rotational angle. Therefore, it is desirable to make the amount of pivotal motion of the hammer 62 larger than that of the conventional hammers. However, if the amount of pivotal motion of the hammer 62 is further increased, the switch body 63 is compressed by a larger degree on a side toward the second movable contact 63*c* remote from the hammer support of the hammer 62 than on a side toward the first movable contact 63*b*, as shown in FIG. 5C, due to differences in the distance from the hammer support of the hammer 62 and the pivotal stroke of the hammer 62. This non-uniform compression of the switch body 63 causes the whole switch body 63 to be inclined mainly about the second movable contact 63*c*. Therefore, there is a fear that the movable contacts 63*b* and 63*c* are displaced or detached from the respective fixed contacts 64*a* and 64*b* after being brought into contact with these, thereby making unstable the contact states between the movable contacts 63*b* and 63*c* and the fixed contacts 64*a* and 64*b*, which brings about the fear that the key depression information cannot be accurately detected.

SUMMARY OF THE INVENTION

It is an object of the present invention to provide a keyboard device for an electronic keyboard instrument, which is capable of ensuring stable operations of movable contacts of a switch body pressed by a hammer, for contact with fixed contacts, to thereby accurately detect key depression information.

To attain the above object, the present invention provides a keyboard device for an electronic keyboard instrument, comprising a key configured to be capable of swinging, a hammer configured to pivotally move in accordance with depression of the key, the hammer having a pressure-applying surface formed in a predetermined configuration, and a key switch configured to detect key depression information on the key, wherein the key switch comprises a substrate having a plurality of fixed contacts provided thereon, a switch body formed of an elastic material and having a pressure-receiving surface, the switch body being formed to be hollow and provided on the substrate in a manner covering the plurality of fixed contacts, and a plurality of movable contacts provided inside the switch body in a manner opposed to the plurality of fixed contacts with respective different spacings therefrom, and configured to be sequentially brought into contact with the plurality of fixed contacts, respectively, as the pressure-receiving surface of the switch body is pressed by the pressure-applying surface of the hammer in accordance with depression of the key, thereby causing compressive deformation of the switch body, and wherein the pressure-receiving surface of the switch body has a same configuration as that of the pressure-applying surface of the hammer, and is disposed such that an orientation of the pressure-receiving surface conforms to an orientation of the pressure-applying surface of the hammer at a time of termination of pivotal motion of the hammer after the plurality of movable contacts are brought into contact with the plurality of fixed contacts, respectively.

According to the keyboard device for an electronic keyboard instrument, as the key is depressed, the hammer pivotally moves to press the pressure-receiving surface of the switch body of the key switch by the pressure-applying surface thereof. As a consequence, the switch body is compressively deformed, and the movable contacts provided on the switch body are sequentially brought into contact with the respective fixed contacts provided on the substrate. Key depression information on the key is detected based on contact or non-contact between the movable contacts and the fixed contacts and a time lag between these contact operations.

Further, the pressure-receiving surface of the switch body has the same configuration as that of the pressure-applying surface of the hammer, and is disposed such that the orientation of the pressure-receiving surface conforms to the orientation of the pressure-applying surface of the hammer at the time of termination of pivotal motion of the hammer after the movable contacts are brought into contact with the respective fixed contacts. With this construction, at the time of termination of pivotal motion of the hammer at which the amount of pivotal motion of the hammer becomes maximum, the degree of compression of the switch body becomes equal between the plurality of movable contacts, i.e. the switch body is substantially uniformly compressed, which prevents inclination of the switch body and, as a consequence, prevents the movable contacts from being displaced or detached from the respective fixed contacts after being brought into contact with them. Thus, even when the amount of pivotal motion of the hammer is large, stable contact operations of the contacts are ensured, which makes it possible to accurately detect key depression information.

Preferably, the pressure-applying surface of the hammer is formed in a convexly curved configuration.

With the configuration of the preferred embodiment, the pressure-applying surface of the hammer is convexly curved, and hence it is easy to maintain the distance between the pressure-applying surface of the hammer and the substrate having the switch body disposed thereon as the pressure-applying surface is pressing the pressure-receiving surface of the switch body. This makes it difficult to cause interference between the substrate and a portion of the hammer other than the pressure-applying surface, particularly an end portion remote from a support for pivotal motion of the hammer. As a consequence, a larger amount of pivotal motion of the hammer can be secured, so that it is possible to make the touch feeling in key depression more similar to a touch feeling provided by an acoustic piano.

The above and other objects, features, and advantages of the present invention will become more apparent from the following detailed description taken in conjunction with the accompanying drawings.

BRIEF DESCRIPTION OF THE DRAWINGS

FIGS. 3A and 3B are enlarged side cross-sectional views of a hammer and a key switch of the keyboard device in FIG. 1 and portions associated with the hammer and the key switch, in which:

FIG. 3A shows the key-released state; and

FIG. 3B shows the key-depressed state.

FIGS. 4A and 4B are schematic side cross-sectional views of a hammer and a key switch of a keyboard device according to a second embodiment, in which:

FIG. 4A shows a key-released state; and

FIG. 4B shows a key-depressed state.

FIGS. 5A to 5C are side cross-sectional views schematically showing the positional relationship between a hammer and a switch body of a conventional keyboard device, in which:

FIG. 5A shows a key-released state;

FIG. 5B shows an initial stage of pivotal motion of the hammer; and

FIG. 5C shows a final stage of the pivotal motion of the hammer.

DETAILED DESCRIPTION OF PREFERRED EMBODIMENTS

Figure 1:
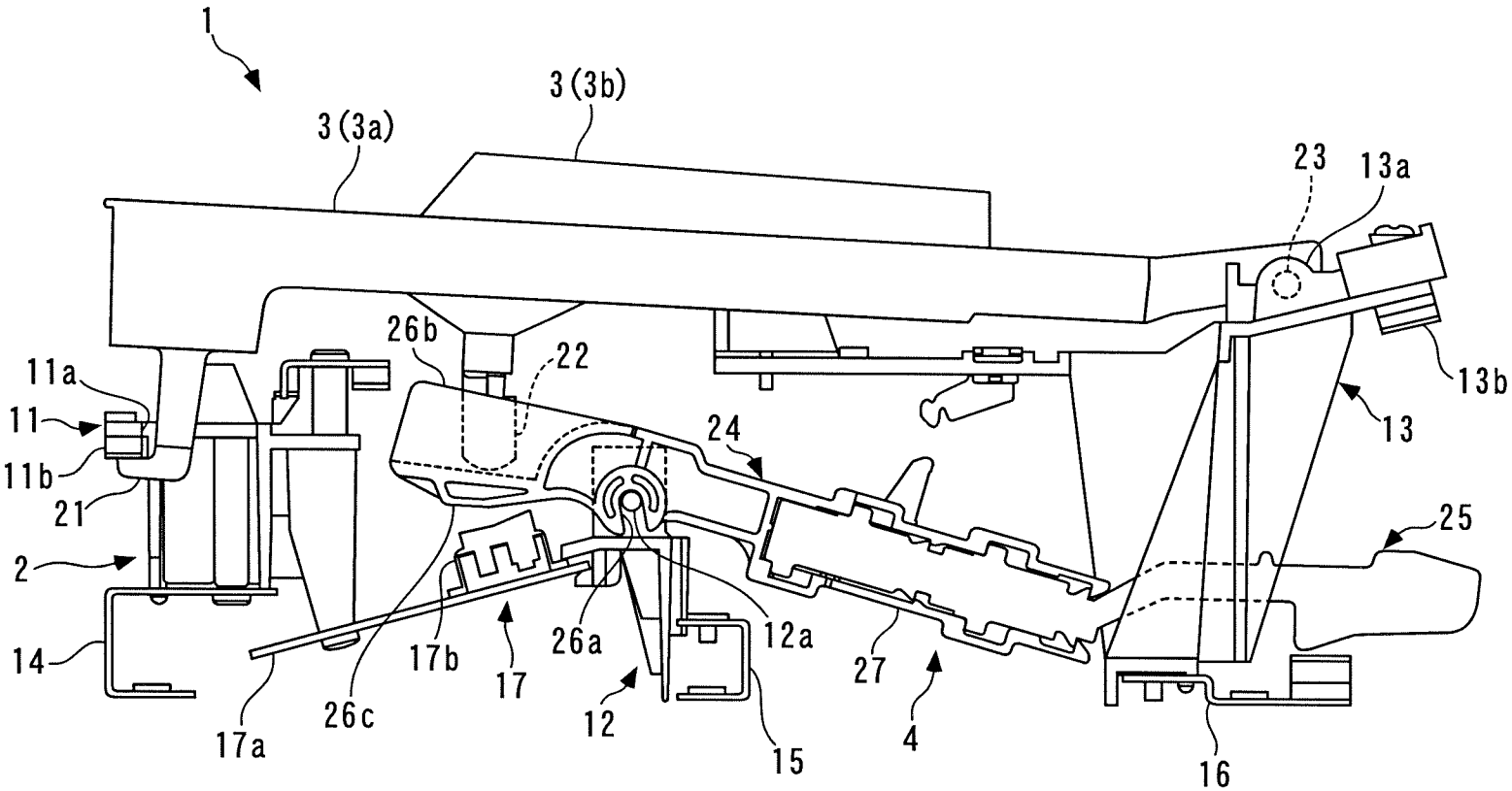
FIG. 1 is a side cross-sectional view of a keyboard device for an electronic piano, according to a first embodiment of the present invention, in a key-released state.
Figure 2:
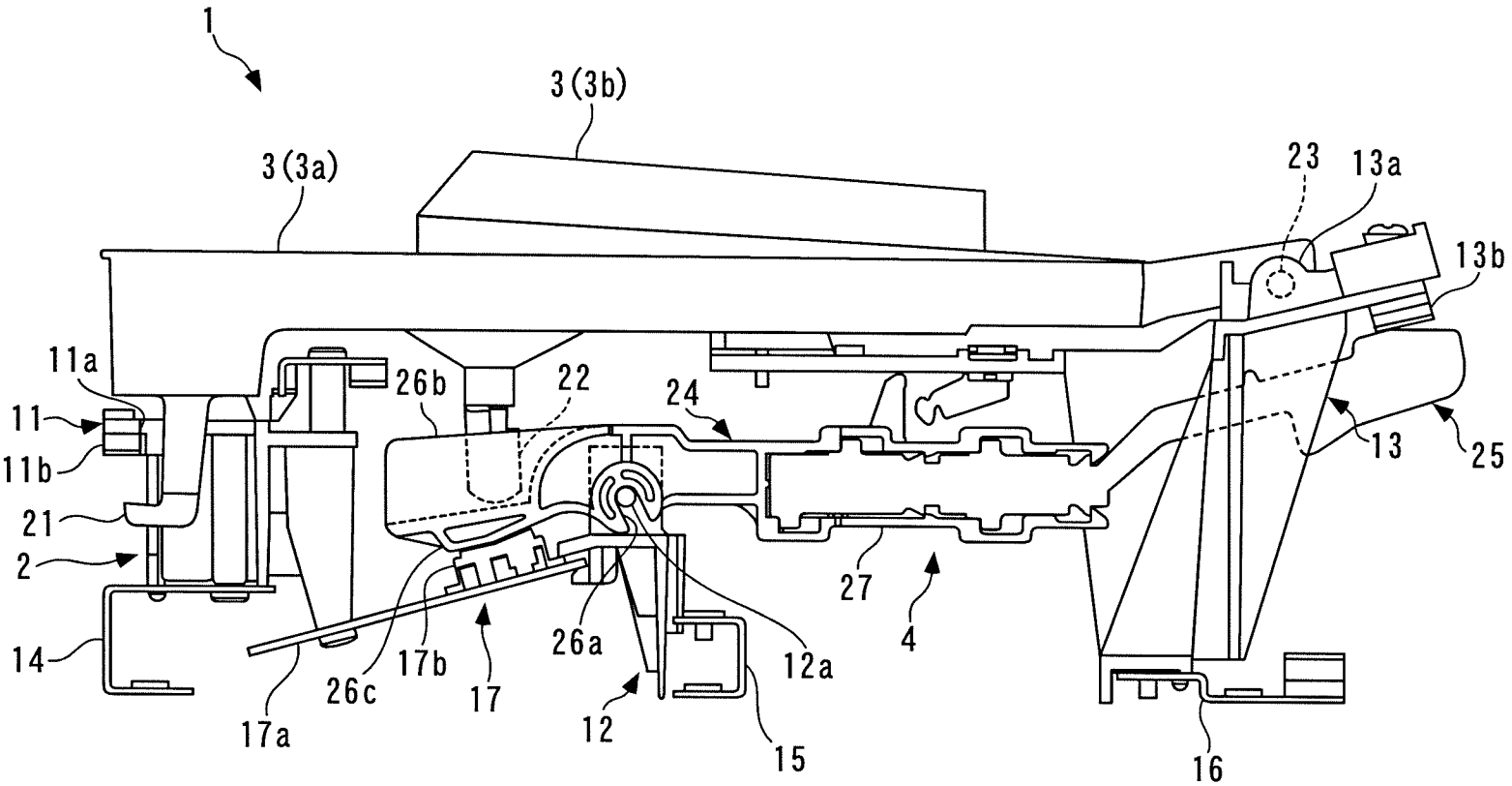
FIG. 2 is a side cross-sectional view of the keyboard device in FIG. 1, in a key-depressed state.

The present invention will now be described in detail with reference to the drawings showing preferred embodiments thereof. It should be noted that in FIGS. 1 to 4, hatching for representing cross-sectional portions is omitted for ease of understanding. FIG. 1 shows a keyboard device 1 for an electronic piano, according to a first embodiment of the present invention, in a key-released state. As shown in FIG. 1, the keyboard device 1 comprises a keyboard chassis 2, a plurality of (e.g. eighty-eight) keys 3 (only one of which is shown) each pivotally mounted on the keyboard chassis 2 and comprising a white key 3*a* and a black keys 3*b*, a plurality of hammers 4 (only one of which is shown) pivotally mounted on the keyboard chassis 2 in association with the respective keys 3, and a key switch 17 for detecting key depression information on each of the keys 3. The white key 3*a* and the black key 3*b* of each key 3 are basically identical in construction, and therefore the following description will be given mainly of the white key 3*a*.

The keyboard chassis 2 comprises a front chassis 11, a central chassis 12, and a rear chassis 13. Each of the chassis 11 to 13 is formed e.g. by an injection molded article of a synthetic resin (e.g. an ABS resin) or the like. The front chassis 11, the central chassis 12, and the rear chassis 13 are connected to each other by ribs (not shown) extending in the front-rear direction, and fixedly mounted on a keybed (not shown) of the electronic piano via respective front, central, and rear mounting rails 14 to 16 each extending in the left-right direction (in which the keys 3 are arranged).

The front chassis 11 has left and right two engaging holes 11*a* and 11*a* (only one of which is shown) formed in association with each white key 3*a* such that they vertically extend through the front chassis 11, and a key stopper 11*b* formed e.g. of felt is attached to the lower surface of a front portion of the front chassis 11.

The central chassis 12 has a shaft-shaped hammer support 12*a* for supporting the hammers 4, and the hammer support 12*a* protrudes leftward and rightward from the central chassis 12. The rear chassis 13 has a shaft hole-shaped key support 13*a* for supporting the keys 3, and a hammer stopper 13*b* formed e.g. of felt is attached to a lower surface of the rear chassis 13 rearward of the shaft hole-shaped key support 13*a*.

Each key 3 is formed e.g. by an injection molded article of a synthetic resin (e.g. an AS resin) or the like. The key 3 has a hollow shape opening downward and extends in the front-rear direction. The key 3 has a rear end thereof formed with a support shaft 23 protruding therefrom leftward and rearward. The support shaft 23 is in engagement with the key support 13*a*, whereby the key 3 is pivotally supported on the rear chassis 13.

Further, each white key 3*a* has a front end thereof formed with a pair of left and right hooks 21 and 21 (only one of which is shown). The hooks 21 and 21 extend downward from the left and right side walls of the white key 3*a* through the respective engaging holes 11*a* and 11*a*, and each of the hooks 21 has a lower end portion thereof bent forward. In a key-released state, the hooks 21 are brought into abutment with the key stopper 11*b* of the front chassis 11 from below, whereby the upper limit position of the white key 3*a* is restricted. Further, the lower surface of the white key 3*a* has a downwardly projecting actuator portion 22 formed rearward of the hooks 21.

Each hammer 4 comprises a hammer body 24 and a weight 25 attached to the hammer body 24. The hammer body 24 is formed by an injection molded article of a synthetic resin (e.g. POM (polyacetal resin)) or the like. The hammer body 24 extends in the front-rear direction and has a shaft hole 26*a* formed slightly forward of the center of the hammer body 24 and having an inverted U shape in side cross-section. The shaft hole 26*a* is in engagement with the hammer support 12*a*, whereby the hammer 4 is pivotally supported on the central chassis 12.

Figure 3A:
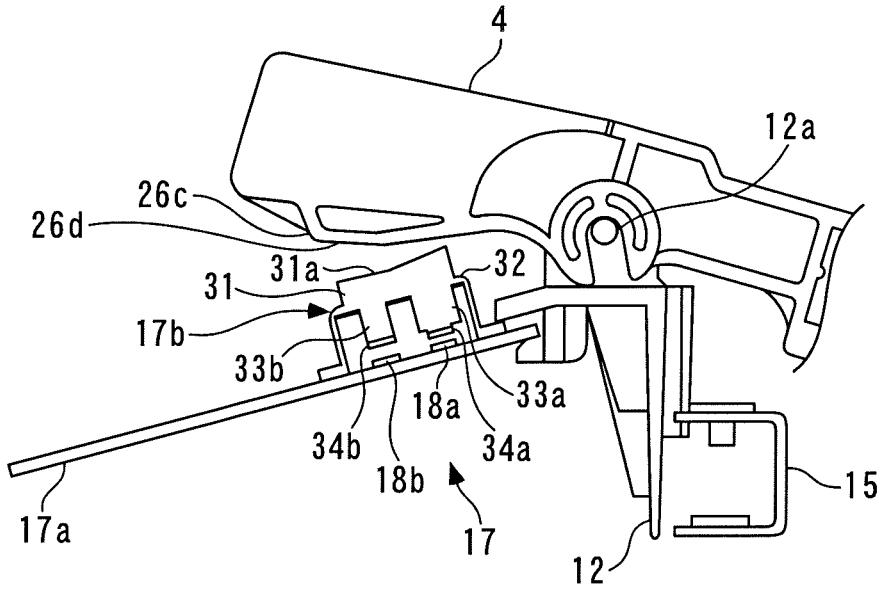
Figure 3B:
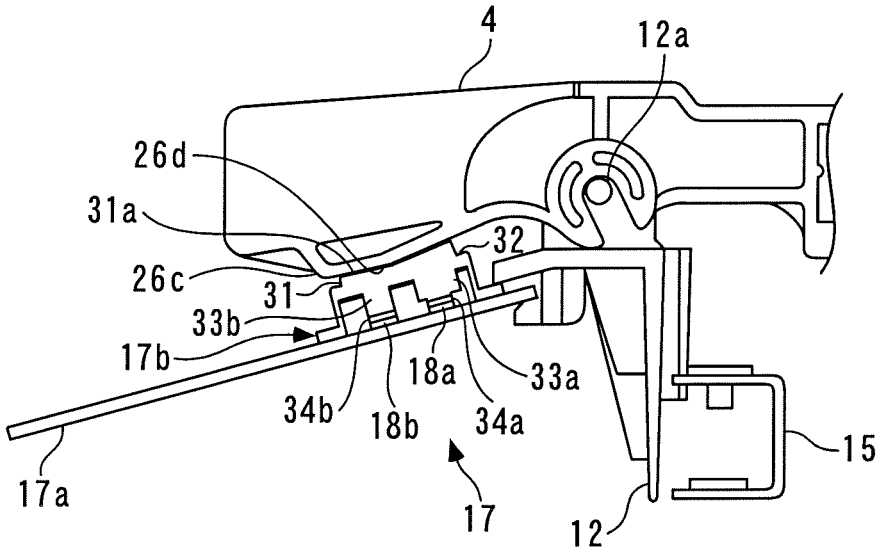

Further, an engaging recess 26*b* opening upward and forward is formed forward of the shaft hole 26*a* of the hammer body 24. The actuator portion 22 of the key 3 is received in the engaging recess 26*b* and held in contact with the bottom surface of the same. The bottom wall of the engaging recess 26*b* of the hammer body 24 functions as a switch pressing portion 26*c* for pressing the key switch 17. As shown in FIGS. 3A and 3B, the switch pressing portion 26*c* has a lower surface which functions as a pressure-applying surface 26*d* having a predetermined configuration, i.e. a slightly downwardly convexly curved configuration.

Further, the rear half of the hammer body 24 has one side thereof formed as a weight mounting portion 27, and the weight 25 is removably mounted in the weight mounting portion 27. The weight 25 is formed by a metal plate of steel or a like material larger in specific gravity than the hammer body 24. The weight 25 is formed into a predetermined shape e.g. by pressing. The weight 25 extends in the front-rear direction, with a front half thereof mounted in the weight mounting portion 27 of the hammer body 24, and extends rearward to a location close to the rear end of the rear chassis 13 in a manner projecting from the weight mounting portion 27.

The key switch 17 comprises a printed circuit board 17*a* and a plurality of switch bodies 17*b* which are attached to the printed circuit board 17*a* in association with the respective keys 3. The printed circuit board 17*a* has a rear end thereof inserted in the central chassis 12 and a front end thereof screwed to the front chassis 11, and extends in the left-right direction in a state inclined forwardly downwardly. Further, as shown in FIGS. 3A and 3B, a first fixed contact 18*a* closer to the hammer support 12*a* and a second fixed contact 18*b* more remote from the hammer support 12*a* are attached to the upper surface of the printed circuit board 17*a* in association with each of the keys 3, in a manner spaced from each other in the front-rear direction by a predetermined distance.

Each switch body 17*b* is formed of an elastic material, such as rubber. The switch body 17*b* has a pressure-receiving portion 31 and a peripheral wall portion 32 integrally formed therewith, and is formed in a hollow shape opening downward. The peripheral wall portion 32 has a lower surface thereof formed with a plurality of bosses (not shown). The bosses are inserted into engaging holes (not shown) of the printed circuit board 17*a*, whereby the switch body 17*b* is mounted on the printed circuit board 17*a* in a manner covering the first and second fixed contacts 18*a* and 18*b*.

The pressure-receiving portion 31 has an upper surface thereof formed as a pressure-receiving surface 31*a*. In a key-released state, the pressure-applying surface 26*d* of the associated hammer 4 faces the pressure-receiving surface 31*a* from above. The pressure-receiving surface 31*a* is slightly downwardly concavely curved, forming a predetermined configuration which is associated with and complementary identical to and tightly fits within that of the pressure-applying surface 26*d* of the hammer 4. Further, as is apparent from comparison between the pressure-receiving surface 31*a* of the switch body 17*b*, shown in FIG. 3A, and the pressure-applying surface 26*d* of the hammer 4, shown in FIG. 3B, the pressure-receiving surface 31*a* is disposed such that the orientation thereof conforms to an orientation of the pressure-applying surface 26*d* at the time of termination of pivotal motion of the hammer 4 (hereinafter referred to as "the hammer pivotal motion termination time").

Further, the pressure-receiving portion 31 is integrally formed with a first mounting portion 33*a* and a second mounting portion 33*b* each extending toward the printed circuit board 17*a*. The length of the first mounting portion 33*a* is slightly larger than that of the second mounting portion 33*b*. A first movable contact 34*a* and a second movable contact 34*b* are attached to the extreme ends of the respective first and second mounting portions 33*a* and 33*b*. The first and second movable contacts 34*a* and 34*b* are opposed to the first and second fixed contacts 18*a* and 18*b*, respectively, from above, and a spacing between the second movable contact 34*b* and the second fixed contact 18*b* is larger than that between the first movable contact 34*a* and the first fixed contact 18*a*.

Next, the operation of the keyboard device 1 will be described with reference to FIGS. 1 to 3B. In the key-released state, the hammer 4 is held rearwardly and downwardly inclined by the weight of the weight 25 as shown in FIGS. 1 and 3A. When the key 3 is depressed in the key-released state, the key 3 pivotally moves about the key support 13*a* in a counterclockwise direction as viewed in FIG. 2, to a position shown in FIG. 2. In accordance with this pivotal motion of the key 3, the actuator portion 22 of the key 3 presses the bottom of the engaging recess 26*b* of the hammer 4 downward. As a consequence, the hammer 4 pivotally moves about the hammer support 12*a* in the counterclockwise direction toward a position shown in FIG. 3B, and the pressure-applying surface 26*d* of the switch pressing portion 26*c* is brought into contact with part of the pressure-receiving surface 31*a* of the switch body 17*b* toward the first movable contact 34*a*. As a consequence, part of the switch body 17*b* toward the first movable contact 34*a* is mainly pressed and compressively deformed. This brings the first movable contact 34*a* into contact with the first fixed contact 18*a*, whereby a first detection signal indicative of the contact state is output.

Then, as the hammer 4 further pivotally moves, the pressure-applying surface 26*d* is brought into contact with part of the pressure-receiving surface 31*a* toward the second movable contact 34*b* as well. As a consequence, part of the switch body 17*b* toward the second movable contact 34*b* is pressed and compressively deformed. This brings the second movable contact 34*b* into contact with the second fixed contact 18*b*, whereby a second detection signal indicative of the contact state is output. Based on the first and second detection signals and a time lag between the two detection signals, key depression information including information on depression or non-depression of the key 3, key depression speed of the same, etc. is detected.

Then, the hammer 4 further pivotally moves while compressively deforming the switch body 17*b* until the rear end of the hammer 4 comes into abutment with the hammer stopper 13*b*. This terminates the pivotal motion of the hammer 4. FIG. 3B shows a state of the hammer 4 at the termination of the pivotal motion thereof. The orientation of the pressure-applying surface 26*d* of the hammer 4 at this time conforms to that of the pressure-receiving surface 31*a* of the switch body 17*b* illustrated in FIG. 3A in a state before being pressed by the hammer 4.

On the other hand, when the key 3 is released after key depression, the hammer 4 pivotally moves in an opposite direction to the direction of the above-described pivotal motion. As the hammer 4 pivotally moves, the key 3 is pushed up via the actuator portion 22 to pivotally move in an opposite direction to the direction of the above-described key depression, and the hooks 21 of the key 3 are brought into abutment with the key stopper 11*b*, whereby the pivotal motion of the key 3 is stopped. This causes each of the key 3 and the hammer 4 to return to the key-released state shown in FIGS. 1 and 3A.

As described above, according to the present embodiment, the pressure-receiving surface 31*a* of the switch body 17*b* has the same configuration as that of the pressure-applying surface 26*d* of the hammer 4, and is disposed such that the orientation of the pressure-receiving surface 31*a* conforms to the orientation of the pressure-applying surface 26*d* of the hammer 4 at the time of termination of the pivotal motion of the hammer 4 after the first and second movable contacts 34*a* and 34*b* are brought into contact with the first and second fixed contacts 18*a* and 18*b*, respectively. With this arrangement, at the time of termination of the pivotal motion of the hammer 4 at which the amount of pivotal motion of the hammer 4 becomes maximum, the degree of compression becomes substantially equal between the part of the switch body 17*b* toward the first movable contact 34*a* and the part of the same toward the second movable contact 34*b*, i.e. the switch body 17*b* is compressed substantially uniformly, which prevents inclination of the switch body 17*b*, and as a consequence, prevents the first and second movable contacts 34*a* and 34*b* from being displaced or detached from the respective first and second fixed contacts 18*a* and 18*b* after being brought into contact with them. Thus, even when the amount of pivotal motion of the hammer 4 is large, stable contact operations of the contacts are ensured, which makes it possible to accurately detect key depression information.

Further, since the pressure-applying surface 26*d* of the hammer 4 is convexly curved, it is easy to maintain the distance between the hammer 4 and the printed circuit board 17*a* as the pressure-applying surface 26*d* is pressing the pressure-receiving surface 31*a* of the switch body 17*b*, which makes it difficult to cause interference between the printed circuit board 17*a* and a portion of the hammer 4 other than the pressure-applying surface 26*d*, particularly an end portion remote from the hammer support 12*a*. As a consequence, a larger amount of pivotal motion of the hammer 4 can be secured, so that it is possible to make the touch feeling in key depression more similar to a touch feeling provided by an acoustic piano.

Next, a keyboard device 41 according to a second embodiment of the present invention will be described with reference to FIGS. 4A and 4B. In the following description, component parts corresponding to those of the keyboard device 1 according to the first embodiment are denoted by the same reference numerals, and detailed description thereof is omitted.

Figure 4A:
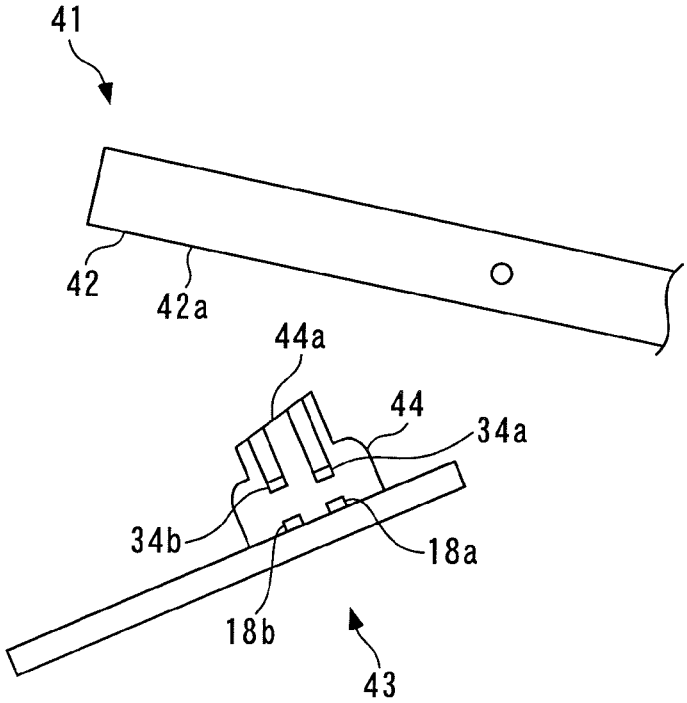
Figure 4B:
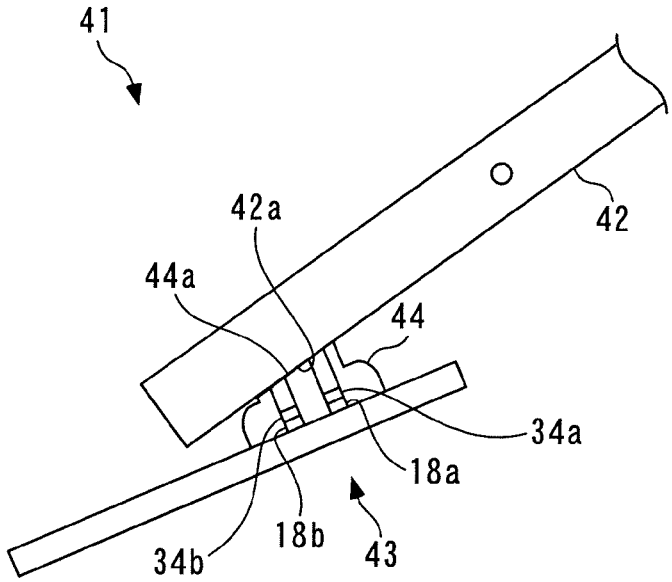
Figure 5A:
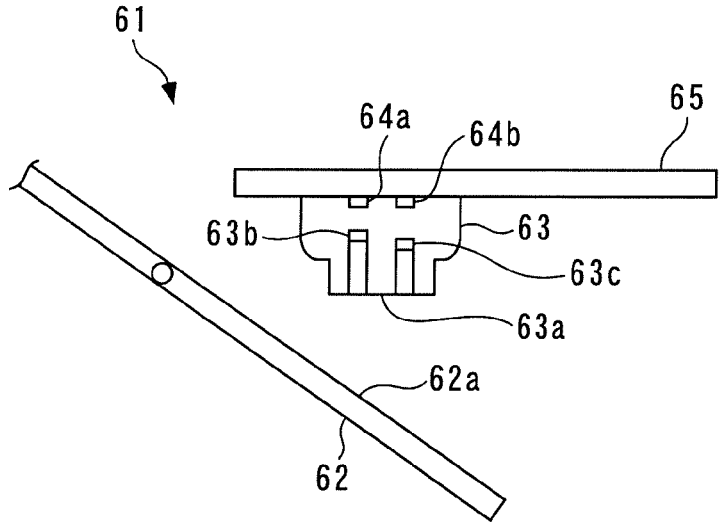
Figure 5B:
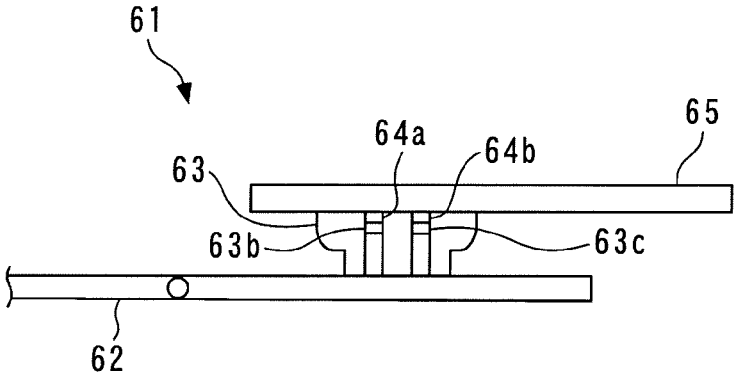
Figure 5C:
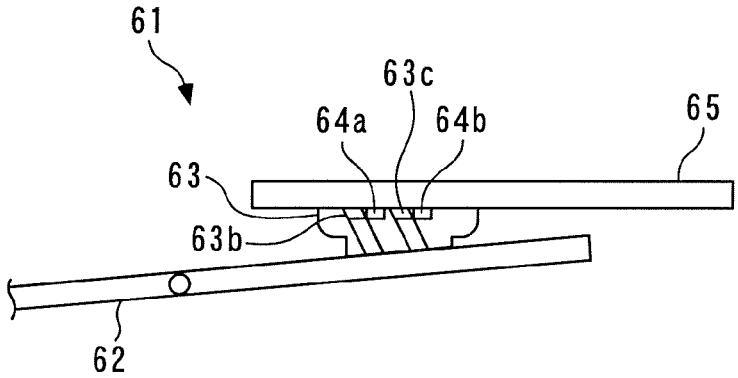

As shown in FIGS. 4A and 4B, the keyboard device 41 is distinguished from the keyboard device 1 according to the first embodiment only by the configuration of a pressure-applying surface 42*a* of a hammer 42 and that of a pressure-receiving surface 44*a* of a switch body 44 of a key switch 43. Specifically, as shown in FIG. 4A, the pressure-applying surface 42*a* of the hammer 42 is formed as a flat surface, and the pressure-receiving surface 44*a* of the switch body 44 is also formed as a flat surface corresponding to the pressure-applying surface 42*a*. Further, as is apparent from comparison between the pressure-receiving surface 44*a* in FIG. 4A and the pressure-applying surface 42*a* in FIG. 4B, the pressure-receiving surface 44*a* is disposed such that the orientation of the pressure-receiving surface 44*a* substantially conforms to an orientation of the pressure-applying surface 42*a* of the hammer 42 at the time of termination of pivotal motion of the hammer 42.

With the above-described arrangement, when the key 3 is depressed in a key-released state shown in FIG. 4A, the hammer 42 pivotally moves in a counterclockwise direction as viewed in FIG. 4A, similarly to the first embodiment, whereby the pressure-applying surface 42*a* of the hammer 42 is brought into contact with the pressure-receiving surface 44*a* of the switch body 44, starting from part of the switch body 44 toward the first movable contact 34*a*, and then part of the same toward the second movable contact 34*b*, whereby the switch body 44 is compressively deformed. This compressive deformation sequentially brings the first and second movable contacts 34*a* and 34*b* into contact with the first and second fixed contacts 18*a* and 18*b*, respectively, in the mentioned order, whereby first and second detection signals indicative of the respective contact states are output.

Thereafter, the hammer 42 further pivotally moves while compressively deforming the switch body 44, and comes into abutment with the hammer stopper 13*b*, whereby the pivotal motion of the hammer 42 is terminated (see FIG. 4B). The orientation of the pressure-applying surface 42*a* of the hammer 42 at the time of termination of the pivotal motion conforms to the orientation of the pressure-receiving surface 44*a* of the switch body 44 illustrated in FIG. 4A in a state before being pressed by the hammer 42.

As described above, according to the second embodiment as well, at the time of termination of pivotal motion of the hammer 42, the degree of compression becomes equal between the part of the switch body 44 toward the first movable contact 34*a* and the part of the same toward the second movable contact 34*b*, i.e. the switch body 44 is compressed substantially uniformly. As a consequence, stable operations of the first and second movable contacts 34*a* and 34*b* for contact with the respective first and second fixed contacts 18*a* and 18*b* are ensured, which makes it possible to accurately detect key depression information.

It should be noted that the present invention is by no means limited to the above-described embodiments, but it can be practiced in various forms. For example, the shape of the pressure-applying surface of the hammer and that of the pressure-receiving surface of the switch body shown in the above-described embodiments are given only by way of example, and any other appropriate shape can be employed. Further, although in the above-described embodiments, two movable contacts and two fixed contacts are provided, more than two movable contacts and more than two fixed contacts may be provided. Furthermore, although in the above-described embodiments, the key switch is disposed below the hammer, these members may be arranged and disposed as desired.

What is more, although in the above-described embodiments, the keyboard device of the present invention is applied to an electronic piano by way of example, it is to be understood that the present invention is also applicable to a keyboard device for any other electronic keyboard instrument.

It is further understood by those skilled in the art that the foregoing are preferred embodiments of the invention, and that various changes and modifications may be made without departing from the spirit and scope thereof.

What is claimed is:

1. A keyboard device for an electronic keyboard instrument, comprising:

a key configured to be capable of swinging;

a hammer configured to pivotally move in accordance with depression of said key, said hammer having a pressure-applying surface having a convexed shape; and a key switch configured to detect key depression information on said key, wherein said key switch comprises:

a substrate having a plurality of fixed contacts provided thereon, a switch body formed of an elastic material and, having a pressure-receiving surface having a concaved shape on the sides along a longitudinal axis of the hammer and flat sides along a lateral axis of the hammer, said switch body being formed to be hollow and configured on said substrate in a manner to cover said plurality of fixed contacts, and a plurality of movable contacts provided inside said switch body in a manner opposed to said plurality of fixed contacts with respective different spacings therefrom, and configured to be sequentially brought into contact with said plurality of fixed contacts, respectively, as the pressure-receiving non-flat surface of said switch body is pressed by the pressure-applying non-flat surface of said hammer in accordance with depression of said key, to cause compressive deformation of said switch body, wherein the pressure-receiving surface of the switch body covers the plurality of movable contacts, and wherein the concaved shape of the pressure-receiving surface of said switch body, in a state not pressed by the pressure-applying surface of said hammer is shaped to be complementary identical and conform to and tightly fit within the convexed shape of the pressure-applying surface of said hammer, and wherein said switch body is disposed such that an orientation of the concaved shape of the pressure-receiving surface conforms to an orientation of the convexed shape of the pressure-applying surface of said hammer after said plurality of movable contacts are brought into contact with said plurality of fixed contacts, respectively to bring said plurality of movable contacts into stable contact with said plurality of fixed contacts, respectively to accurately detect said key depression information.

2. The keyboard device according to claim 1, wherein the hammer is configured to pivotally move around a pivot, wherein a spacing between a first moveable contact inside said switch body farthest to the pivot and a corresponding first fixed contact is larger than a spacing between a second moveable contact inside said switch body closest to the pivot and a corresponding second fixed contact.

* * * * *